US005204844A

United States Patent [19]

Erickson

[11] Patent Number: 5,204,844

[45] Date of Patent: Apr. 20, 1993

[54] MOMENT BENDER TRANSDUCER

[75] Inventor: David J. Erickson, Liverpool, N.Y.

[73] Assignee: General Electric Company, Syracuse, N.Y.

[21] Appl. No.: 831,837

[22] Filed: Feb. 6, 1992

Related U.S. Application Data

[63] Continuation-in-part of Ser. No. 633,142, Dec. 24, 1990, abandoned.

[51] Int. Cl.[5] ..... H04R 17/00

[52] U.S. Cl. ..... 367/163; 367/174; 310/334; 310/337

[58] Field of Search ..... 367/157, 163, 174; 310/334, 337

[56] References Cited

U.S. PATENT DOCUMENTS 2,906,991 9/1959 Camp ..... 367/157

3,449,712 6/1969 Angeloff ..... 367/157

*Primary Examiner*—J. Woodrow Eldred

*Attorney, Agent, or Firm*—Paul Checkovich; Stephen A. Young

[57] ABSTRACT

A transducer includes a first and second spaced apart member, each member having a radiating surface for producing a wave of energy in a transmitting medium in response to a driving force, a plurality of containment devices coupled to each member and extending outwardly beyond at least one radiating surface for communicating the driving force to each member, and a corresponding plurality of driving devices respectively disposed within the containment devices for generating the driving force in response to a change in a predetermined dimension of the driving device. The distance between the members and corresponding distance between the radiating surfaces may be reduced for increasing the bandwidth of the transducer, while the length of the containment device may be increased for accommodating the driving devices in order to maintain a constant driving force. A method for selecting the bandwidth of operation of a transducer is also described.

15 Claims, 4 Drawing Sheets 10
20
25
30
32
34
35
37
38
39
40
42
43
44
45
46
47
49
50
52
54
56
58
22
27
2B

MOMENT BENDER TRANSDUCER

This application is a continuation-in-part of copending patent application entitled "Moment Bender Transducer" filed on Dec. 24, 1990 having a Ser. No. 07/633,142 and assigned to the same assignee as hereof, now abandoned.

BACKGROUND OF THE INVENTION

The present invention relates to a moment bender transducer, and, more particularly, to an improved moment bender transducer.

The aforementioned U.S. patent application Ser. No. 07/633,142 describes and claims a moment bender transducer which may be of particular benefit for generating low frequency (i.e., less than about 1,000 Hz) acoustic signals. Although the transducer of U.S. patent application Ser. No. 07/633,142 is cost effective, especially with respect to being able to use flat radiating members, there are certain situations for which it is desirable to increase the bandwidth of operation of the transducer, while maintaining the output or source power, if desired, so that the amount of acoustic energy that is able to be coupled from the transducer to the conducting or transmitting medium for a predetermined drive power level over that attainable using the transducer of U.S. patent application Ser. No. 07/633,142 may be increased.

SUMMARY OF THE INVENTION

In accordance with the present invention, a transducer includes a first and second spaced apart member for defining an inner spacing therebetween, with each member having a corresponding spaced apart radiating surface for generating a wave of energy in a transmitting medium in response to a driving force that is communicated to each member. The transducer further includes a plurality of containment means coupled to each member and extending outwardly beyond at least one of the radiating surfaces for communicating the driving force to each member, a corresponding plurality of driving means respectively disposed within the containment means for generating the driving force in response to a change in a predetermined dimension of the driving means from influence by excitation energy and sealing means connected to each member for preventing transmitting fluid from entering the spacing between the members.

Each member may include a flat plate that may be disposed so that the radiating surfaces include a respective major flat surface with the radiating surfaces disposed parallel or substantially parallel each other. Further, the spacing between the members and corresponding spacing between the radiating surfaces may be selected for operating at a predetermined bandwidth. The bandwidth is inversely proportional to the distance between the radiating surfaces, while the size of the containment means, such as in a longitudinal direction, is selectable to accommodate such spacing. Each plate may include a respective cylindrical margin to define a disk with the containment means circumferentially spaced apart with respect to each other. The spacing between the members may be selected to be at a minimum acceptable distance so that the members do not contact each other during operation, whereby a maximum bandwidth may be obtained.

The containment means may extend beyond each of the radiating surfaces, such as in a transverse or perpendicular direction with respect to the at least one radiating surface and a longitudinal axis of the containment means. Further, the containment means may include a protrusion from each radiating surface beyond which it extends wherein protrusions from respective radiating surfaces are aligned or registered.

In another aspect of the present invention, a transducer assembly having a selectable steepness of resonance and a corresponding selectable bandwidth includes radiating means for generating a wave of energy in response to a driving force having a first and second spaced apart surface disposed at a predetermined spacing with respect to each other, driving means coupled to the radiating means with a first quiescent longitudinal dimension and extending beyond the first surface for changing the size of the longitudinal dimension in response to excitation energy and sealing means connected to the radiating means for preventing transmitting fluid from entering the spacing between the first and second surface. A change in the longitudinal dimension of the driving means imparts a component of the driving force transverse the first and second surface, wherein the bandwidth is inversely proportional to the value of the spacing or distance between the first and second surfaces. The radiating means may include a first and second flat disk with the first surface disposed on the first disk and the second surface disposed on the second disk with the driving means including a plurality of circumferentially spaced apart containment means connected to the first and second disk for coupling the component of the driving force to the first and second disk.

In yet another aspect of the present invention, a method for selecting the bandwidth of a transducer includes providing a spaced apart first and second member to form a space therebetween with the first and second member having a respective radiating surface for generating a wave of energy in a transmitting medium in response to a driving force, disposing a plurality of containment means to extend outwardly beyond at least one of the radiating surfaces for communicating the driving force to the members, coupling one of a corresponding plurality of driving means to a respective one of the containment means for generating the driving force in response to a change in a predetermined dimension of the driving means and sealing the space between the members against invasion by transmitting medium, wherein the bandwidth of the transducer is inversely proportional to the distance between the respective radiating surfaces.

The containment means may be disposed to extend outwardly beyond both of the radiating surfaces. The first and second member may each include a respective flat plate that are disposed so that the respective radiating surfaces are parallel each other with the containment means disposed so that a longitudinal axis thereof is perpendicular one of the radiating surfaces.

BRIEF DESCRIPTION OF THE DRAWING

The features of the invention believed to be novel are set forth with particularity in the appended claims. The invention itself, however, both as to organization and method of operation, together with objects and advantages thereof, may best be understood by reference to the detailed description taken in connection with the accompanying drawing, in which:

DETAILED DESCRIPTION

Figure 1:
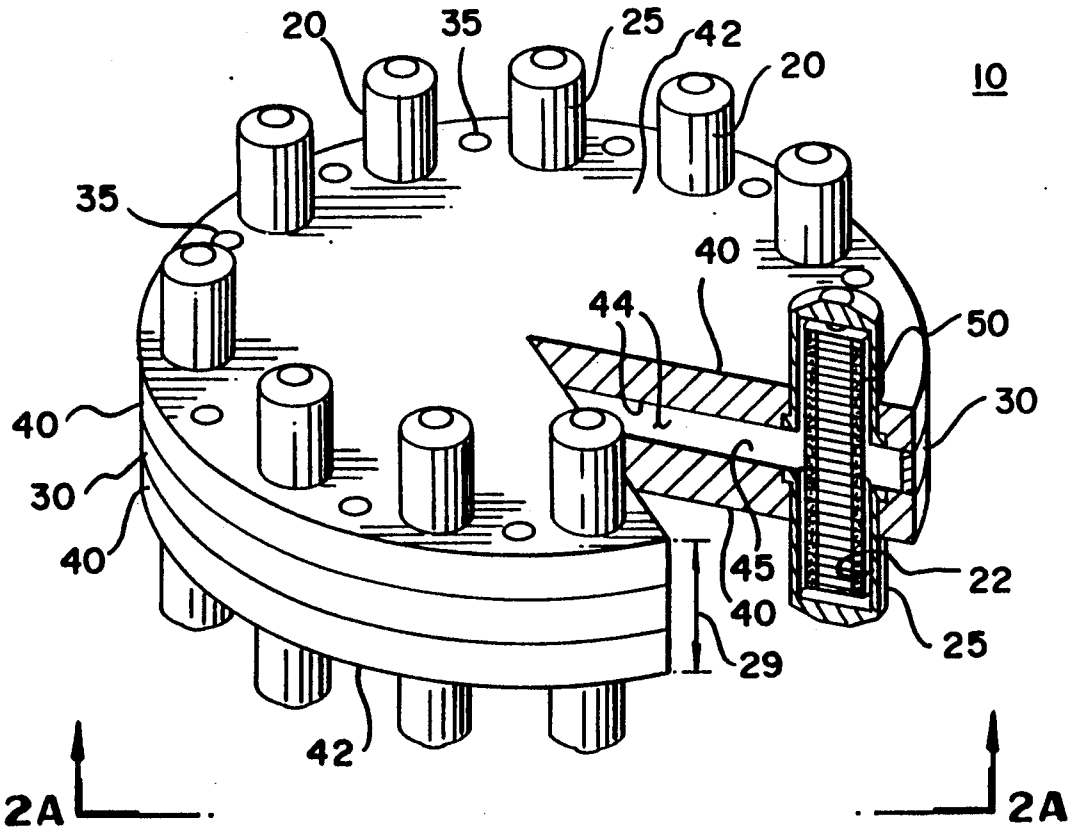
FIG. 1 is an isometric view of a transducer, having a partial cut-away for ease of viewing, in accordance with the present invention.

Referring to FIG. 1, an isometric view of a transducer, having a partial cut-away for ease of viewing, in accordance with the present invention is shown.

Transducer 10 includes a pair of spaced apart flat cylindrical disks 40, defining a space 45 between them, a cover 30 connected to disks 40 at the outer margin thereof and extending therebetween for preventing transmitting fluid from entering space 45, a plurality of hollow elongated containment means 20, such as chambers, and an plurality of elongated driving means 50 with a corresponding one of driving means 50 disposed within each chamber 20 for ultimately applying via containment means 20 a driving force having at least a portion or component of which is transverse disks 40 for bending or flexing disks 40. Containment means 20 are shown disposed transverse surfaces 42 and extend outwardly beyond surfaces 42.

Disk 40 includes a plurality of elongated columns, or protrusions, 25 fixedly sealingly connected to, or integral with, disk 40 and extending outwardly away from a major, or outer, surface, 42 of disk 40, and away from the plane of surface 42 when surface 42 is flat. Protrusion 25 includes an internal cavity, or blind end hole or bore, 22 that extends from near the outer longitudinal end of protrusion 25 to communicate with the other major, or inner surface, 44 of disk 40 and with space 45. Surface 44 forms a boundary of space 45. A portion of both disk 40 and the interior of protrusion 25 may have to be removed during fabrication to establish cavity 22 with an unobstructed communication path to surface 44. Although not shown, energizing communication means, such as electrical wire or cable, may be directed from outside transducer 10 through fluid sealed ports in cover 30 and/or in one or more protrusions 25 and be distributed to driving means 50 within space 45 and cavity 22 as desired.

It is sufficient that containment means 20 be disposed with respect to surfaces 42 so that at least a portion of the total force exerted thereon by driving means 50 during operation is ultimately directed transverse surface 42. Thus, for example, the longitudinal axis of containment means 20 and/or protrusions 25 may be other than perpendicular to surface 42.

Surface 42 may be flat over its entire expanse. Disks 40 may be operationally connected so that corresponding outer surfaces 42 for generating a wave of energy when disposed in the transmitting medium are parallel or substantially so.

Individual protrusions 25 are shown circumferentially spaced apart and disposed near the outer periphery of disk 40. A pair of disks 40 are disposed so that surfaces 44 thereof oppose each other while corresponding cavities 22 of protrusions 25 are operationally aligned and registered to form chamber 20 for receiving driving means 50. Driving means 50 may be the same or different from driving means 30 and/or 50 that are described in U.S. patent application Ser. No. 07/633,142. That is, driver means 50 may include an electroactive material.

The number of protrusions 25 per disk 40 is not deemed to be critical, and an odd or even number may be selected, with the understanding that each disk 40 will include the same number of protrusions 25 which are disposed on the other disk 40 for forming a corresponding containment means 20. However, it is believed that a symmetrical arrangement of protrusions 25 will be determined to be desirable for most cases. Further, the circumferential and/or radial spacing between protrusions may be selected as desired. Respective protrusions 25 will be complementarily disposed so that when faces 44 of disks 40 are operationally opposed to each other and cavities 22 are registered, the same number of complete chambers 20 are formed as there are protrusions 25 on one disk 40.

When transducer 10 is operationally disposed in a transmitting medium, surfaces 42 of respective disks 40 act as radiating, or transmitting medium stimulating, sources, in that when they move, they cause a corresponding movement of the transmitting medium, which transmitting medium movement is typically referred to as a wave (if continuous) or pulse (if not continuous) of energy. Further, the amount of acoustic energy that is able to be coupled from surfaces 42 of disks 40 to surrounding transmitting medium for a predetermined length of driving means 50 is a function of the sharpness of resonance, or bandwidth, of transducer 10, which is explained more fully with respect to FIG. 5.

Figures 2A, 2B:
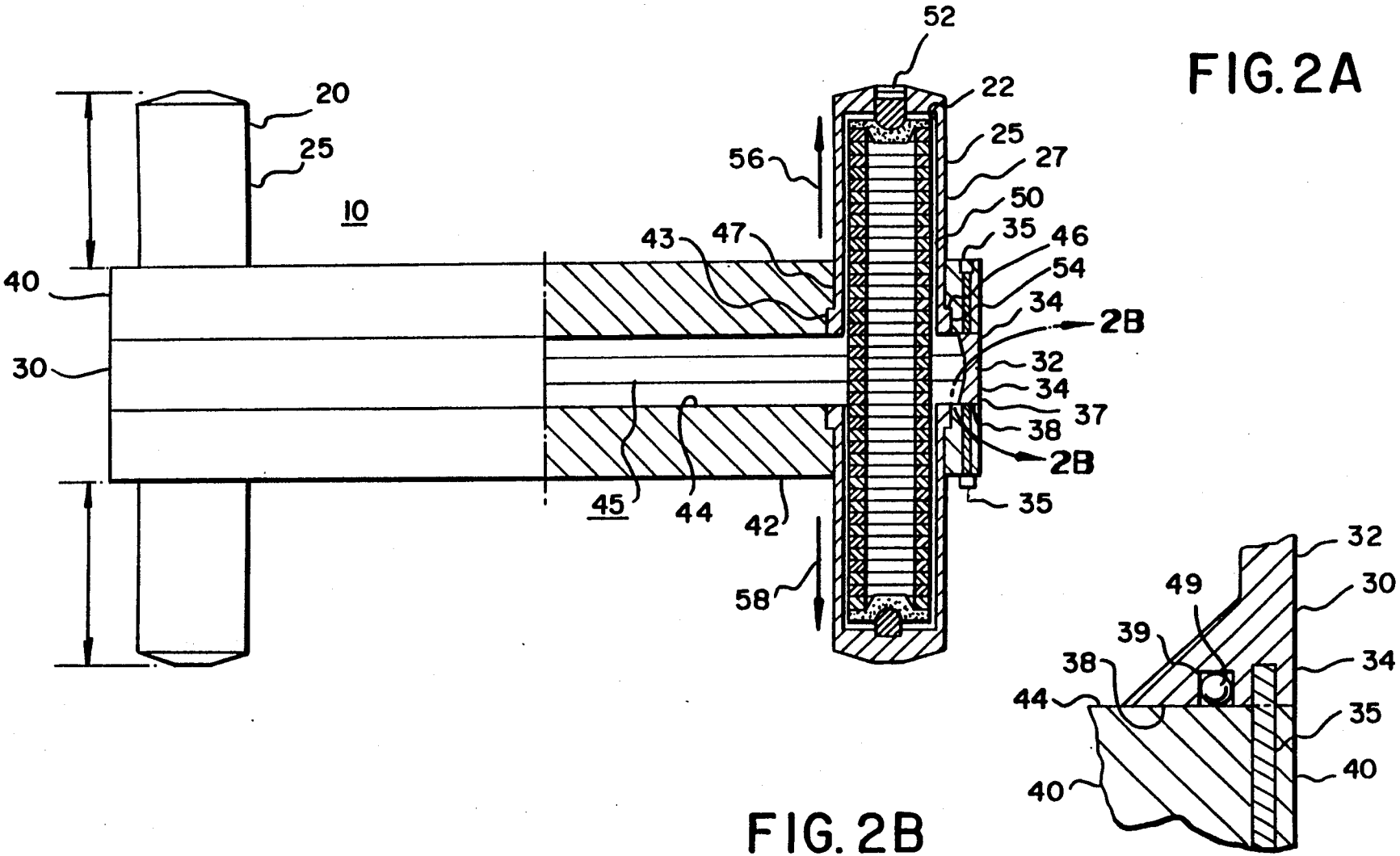
FIG. 2A is a view, not necessarily to scale, looking in the direction of the arrows of line 2A—2A of FIG. 1 with certain components eliminated to avoid undue repetition.
FIG. 2B is an exploded view, not necessarily to scale, of the area enclosed by the line of FIG. 2A having arrows labelled 2B.

Referring to FIG. 2A, a view, not necessarily to scale, looking in the direction of the arrows of line 2A—2A of FIG. 1 is shown. The view shown is substantially an elevational view looking onto the cut-away surfaces of disks 40 that are shaded with biased lines in FIG. 1. Certain components, significantly some protrusions 25, have been eliminated to avoid undue repetition.

At the closed, sealed end of protrusion 25 is disposed driving mounting means 52 for supporting driving means 50. Driving mounting means 52 may be the same or different from driver mounting means 60 and/or 70 that are described in U.S. patent application Ser. No. 07/633,142. It is here noted that only as much of a description as is deemed necessary for a complete understanding of the present invention is included in this application. Additional details of fabrication and operation may be had by reference to U.S. patent application Ser. No. 07/633,142.

As shown in cross-section, cover 30 may include a narrower middle section 32 that tapers radially inwardly from section 32 while progressing in both outward directions along the central axis of cover 30 from middle section 32 through straddling outer sections 34 to form a wider surface 38 that abuts surface 44 of disk 40. Fastening means 35, such as a screw or bolt, may extend through disk 44 to engage an internally threaded cavity 37 of cover 30 that terminates at the outer surface 38 of cover 30. Cavity 37 is disposed in the longitudinal end of cover 30 for receiving fastening means 35 for sealingly securing together disks 40 with cover 30 disposed therebetween. A countersink or counterbore may be included from surface 42 of disk 40 and partially through disk 40 for permitting the head of bolt 35 to be recessed until flush with surface 42.

In the embodiment of the present invention that is shown in FIG. 2A, protrusion 25 is separate from disk 40. Protrusion 25 preferably has an outer cylindrical surface 27 and includes fastening means 54, such a circumferential flange, that is disposed around the open end of protrusion 25 and extends outwardly from its outer surface 27 so that the diameter of the periphery of flange 54 is greater than the diameter of surface 27. Disk 40 includes a counterbore, or recess, 43 from surface 44 that extends partially through disk 44 to form a step or notch 46. The diameter of counterbore 43 is equal to or slightly larger than the diameter of the outer peripheral surface of flange 54 of protrusion 25, while the length of counterbore 43 into disk 40 is approximately equal to the longitudinal height of flange 54 so that the longitudinal trailing surface of protrusion 25 may be assembled flush with surface 44 of disk 40. Flange 54 ultimately transmits to disk 40 an outward component of the force exerted by driving means 50 on protrusion 25 of containment means 20 during operation.

A hole 47 having a diameter equal to, or slightly greater than, the diameter of outer surface 27 of protrusion 25 lies concentric with counterbore 43 and extends from the bottom of counterbore 43 through disk 40 to terminate at surface 42 of disk 40. Sealing material or sealing means (not shown), analogous to that illustrated and described between plate 40 and cover 30 of FIG. 2B, with an O-ring if desired, preferably disposed from surface 47 into disk 40, may be disposed between surface 27 of protrusion 25 and surface 47 of disk 40 for preventing transmitting medium from entering space 45.

During assembly, protrusion 25 may be inserted with the closed end of protrusion 25, or support end for driving means 50, leading into counterbore 43 and exiting through hole 47 so that flange 54 is sealingly seated within counterbore 43. Of course, if protrusion 25 is fabricated to be integral disk 40, then internal cavity 22 must be accounted for, such as, for example, by casting and/or machining.

Referring to FIG. 2B, an exploded view, not necessarily to scale, of the area enclosed by the line of FIG. 2A having arrows labelled 2B is shown.

Longitudinal surface 38 that is disposed at both ends of cover 30 and the cooperating area of surface 44 of disk 40 that operationally abuts surface 38 may be fabricated, such as by machining, to be smooth so that surface 44 contacts surface 38 over the entire expanse of surface 38. A sealing material may be applied between surfaces 38 and 44 for forming a gasket in situ. Cover 30 may also include a circumferential groove or channel 39 which extends from surface 38 partially into section 34 of cover 30. Channel 39 may be sized for receiving sealing means 49, such as an O-ring. Channel 39 is further sized s that when O-ring 49 is operationally disposed within channel 9, O-ring 49 sealingly engages the lateral walls and end wall of channel 39, and also sealingly engages surface 44 of disk 40, for preventing transmitting fluid that is external to transducer 10 from entering space 45 (FIG. 2A) that is contained between disks 40.

Figure 3:
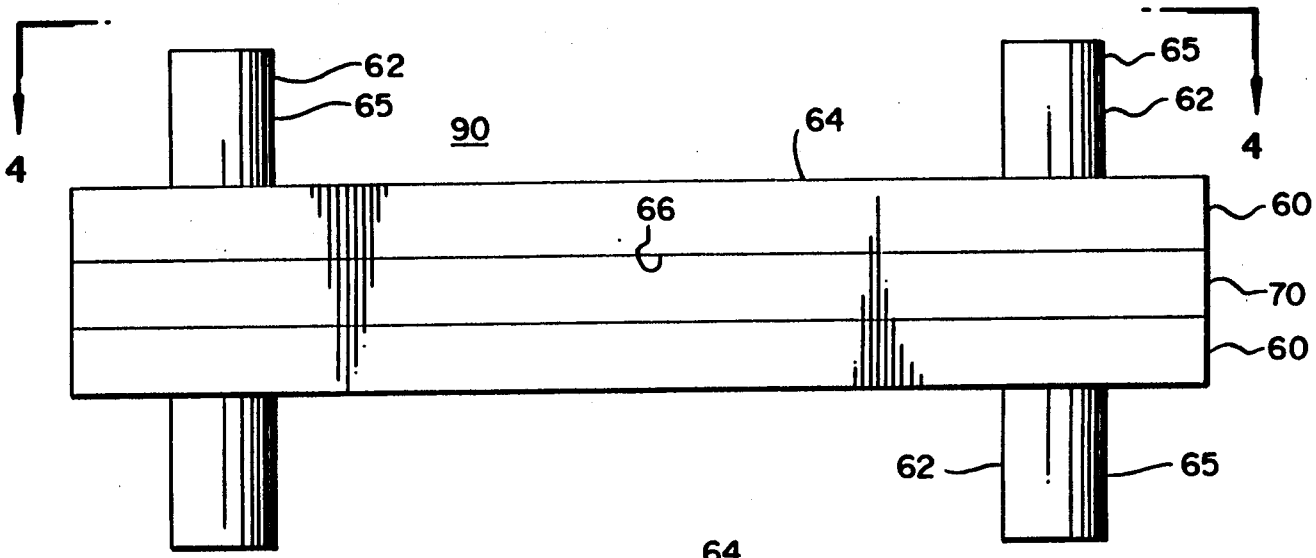
FIG. 3 is a side elevational view of another embodiment of a transducer in accordance with the present invention.

Referring to FIG. 3, a side elevational view of another embodiment of a transducer in accordance with the present invention is shown.

Transducer 90 includes a pair of spaced apart flat plates 60 that are shown as rectangular, a plurality of containment means, such as columns 62, including a respective plurality of protrusions 65 that extend outwardly from respective plates 60 and that are physically analogous to, and operationally aligned and registered for forming containment means 62 analogously to protrusions 25 of the embodiment of the present invention that is shown in FIG. 1, and a cover 70 that is disposed at the outer periphery of plates 60 and sealingly connected thereto for preventing transmitting fluid that is external transducer 90 from entering the internal spaces of transducer 90. Cover 70 may be sealed to plates 60 analogously to cover 30 being sealed to disks 40. The spacing between plates 60 may be determined analogously to that between disks 40, which is explained in detail with respect to FIG. 5.

Figure 4:
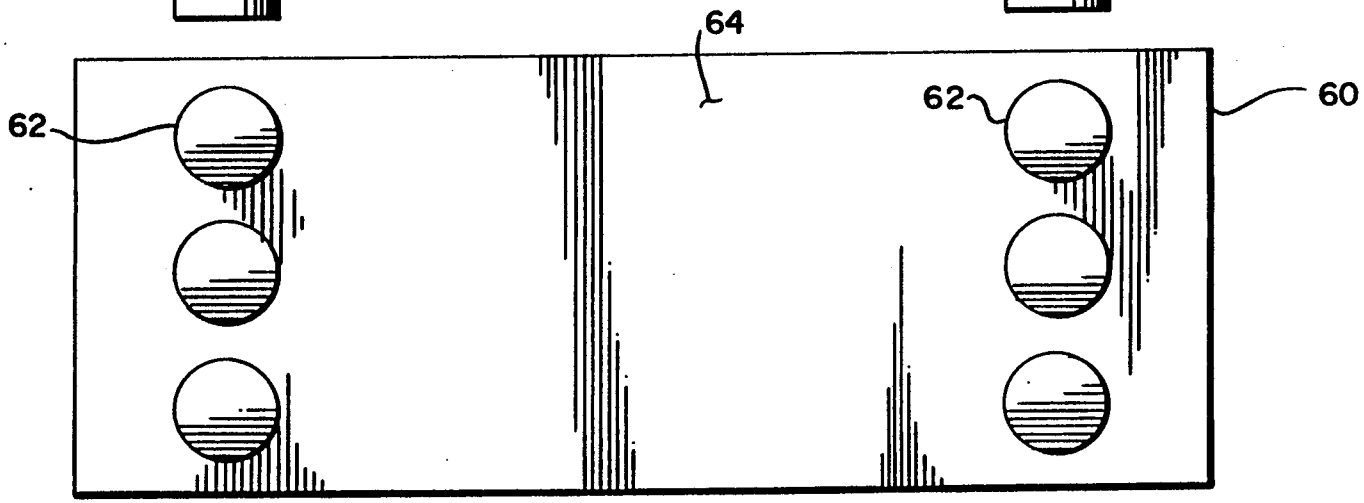
FIG. 4 is a view looking in the direction of the arrows of line 4—4 of FIG. 3.

Referring to FIG. 4, a view looking in the direction of the arrows of line 4—4 of FIG. 3 is shown.

Protrusions 65 are illustrated as having a round or cylindrical contour with a longitudinal axis shown perpendicular to surface 64. Protrusions 65, cover 70 and columns 62 may be the same, or analogous to, protrusions 25, cover 30 and columns 20, respectively, of the embodiment of the present invention that is shown in FIG. 1.

Figure 5:
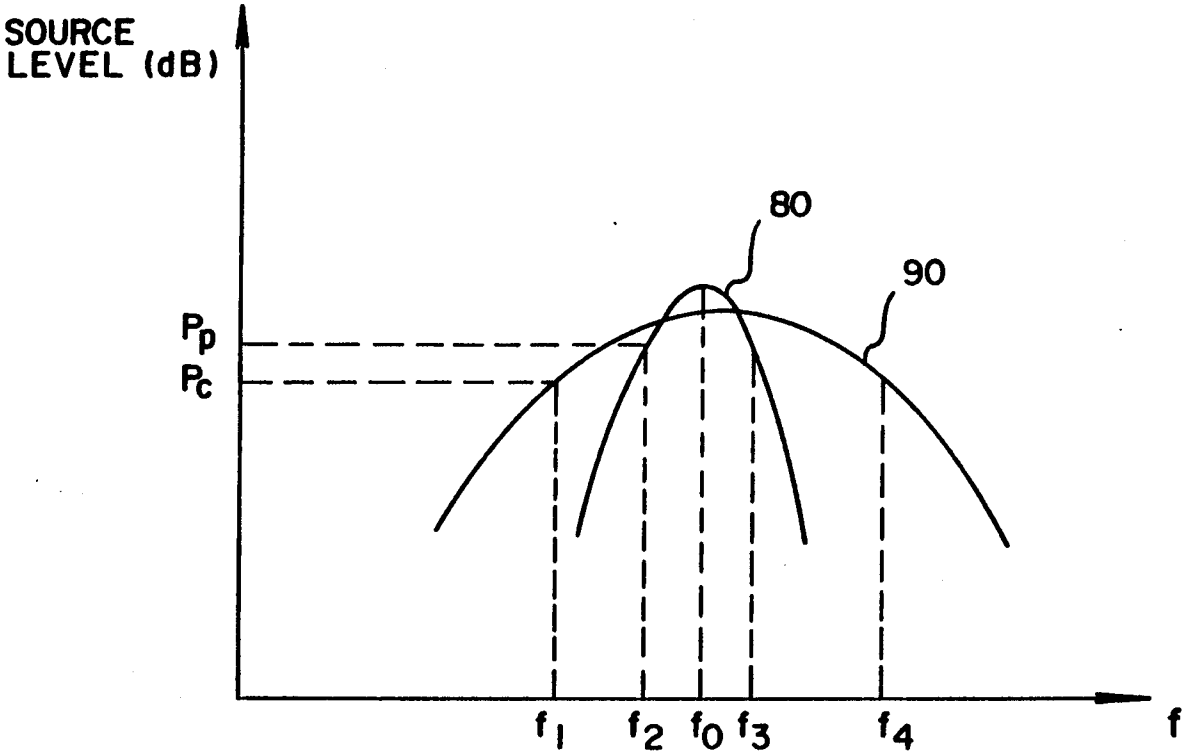
FIG. 5 is a graphic representation of one aspect of expected performance of a prior transducer and of the same aspect of expected performance of a transducer in accordance with the present invention.

Referring to FIG. 5, a graphic representation of one aspect of expected performance of a prior transducer and of the same aspect of expected performance of a transducer in accordance with the present invention is shown.

The prior transducer may be similar to the transducer shown in FIGS. 1 and 2 of U.S. patent application Ser. No. 07/633,142. Curve 80 represents the expected performance of the prior transducer and curve 90 represents the expected performance of a transducer in accordance with the present invention, both not necessarily to scale, with respect to source level in dB versus frequency f. Source level (dB), with increasing source level in the direction of the arrow, is designated along the ordinate while frequency (f), with increasing frequency in the direction of the arrow, is designated along the abscissa.

It is noted that the peak amplitude of curve 80 is located at frequency $f_o$, while the bandwidth of curve 80 as measured at the generally accepted points on the curve on respective sides of the peak amplitude that are 3 db lower in power than the peak amplitude of curve 80, may be represented by the frequency difference $f_3-f_2$. Likewise, although the peak amplitude of curve 90 is shown as also occurring at frequency $f_o$, but not being as great as that of curve 80, the bandwidth of curve 90 as determined by the same criterion as that used for determining the bandwidth of curve 80, may be represented by the frequency difference $f_4-f_1$. Clearly, inasmuch as frequency $f_1$ is less than frequency $f_2$ and frequency $f_4$ is greater than frequency $f_3$, the value of $f_4-f_1$ is greater than that of $f_3-f_2$, so that the corresponding bandwidth of curve 90 as shown is necessarily greater than that of curve 80. In other words, it may be said that curve 90 is flatter than curve 80, or that curve 80 has a higher Q (figure of merit) or greater sharpness of resonance than does curve 90.

One aspect of significance of the bandwidth of a transducer system that may be determined from a source level versus frequency plot like that shown in FIG. 5 is that such bandwidth may be viewed as indicative of the amount of power that can be coupled from the radiating surfaces of a transducer into the transmitting medium. That is, although the source level or power from curve 80 is greater than that of curve 90 over a frequency band that is indicated as less than $f_3$–$f_2$, over the remaining portion of the bandwidth $f_4$–$f_1$ of curve 90 the source level from curve 90 is greater than that of curve 80. Toward the boundary frequencies $f_1$ and $f_4$ of the bandwidth of curve 90 the source level from curve 90 becomes significantly and substantially greater than that of curve 80. Because of its relatively high resonance, especially with respect to that of curve 90, the source level from curve 80 decreases, or rolls off, rapidly with respect to that of curve 90 as the frequency decreases from $f_2$ or increases from $f_3$, wherein frequencies $f_2$ and $f_3$ represent the boundaries or extremities of the bandwidth of curve 80.

One identified factor which affects the sharpness of resonance of a transducer system of the type shown in U.S. patent application Ser. No. 07,633,142, or of one in accordance with the present invention, is the spacing between the radiating surfaces of the transducer. Such spacing may be represented by the longitudinal distance or spacing 29 (FIG. 1) between surfaces 42 of respective disks 40 of transducer 10, and by the longitudinal spacing between the outer surfaces (not numerically identified) of respective disks 20 of the transducer shown in FIG. 1 of U.S. patent application Ser. No. 07/633,142. This relationship may be expressed as: when the radiating surfaces of a transducer are spaced apart surfaces as shown, the sharpness of resonance, and the corresponding bandwidth, are inversely proportional to the distance between the radiating surfaces. That is, as the distance between the radiating surfaces decreases, the sharpness of resonance decreases, or in other words, as such distance decreases, the representative curve of source level versus frequency will tend to flatten out, thereby increasing the bandwidth of the transducer.

For cases where a wider bandwidth and corresponding lesser sharpness of resonance is desired, such as for increasing the bandwidth over which a larger amount of generated power may be coupled to a transmitting medium, the spacing between radiating surfaces may be decreased. One limit on the amount such spacing can be reduced may be understood by reference to FIG. 1.

As longitudinal distance 29 is reduced to decrease the mutual separation of radiating surfaces 42, there is a corresponding reduction in the longitudinal spacing of interior opposing surfaces 44. Inasmuch as disks 40 are caused to flex, vibrate or oscillate during operation by appropriate excitation of driving means 50, as explained in detail in U.S. patent application Ser. No. 07/633,142, the spacing between surfaces 44 of disks 40 should not be reduced to such an extent that surfaces 44 will contact or strike each other during operation. The minimum distance between disks 40 for which such undesired contact does not occur may be referred to as the minimum acceptable distance.

The spacing between disks forming the radiating surfaces of the transducer of FIG. 1 of U.S. patent application Ser. No. 07/633,142 is determined by the height of driver means 30 and/or 50 and may be reduced, which would necessitate at least a reduction in the height or longitudinal dimension of driver means 30 and/or 50, along with a similar reduction in other components which are not germane to this discussion. The total change in dimension between the extremities or ends of driver means 30 and/or 50 in the longitudinal direction when they are activated, and therefore the ultimate amplitude of the force applied to the radiating members, is directly proportional to the overall length of the respective driver means 30 and/or 50 in the quiescent state. That is, the shorter the length of driver means 30 and/or 50, the less the ultimate force on the radiating members.

However, placing driving means 50 within columns 20, in accordance with the present invention, permits the quiescent length, height or longitudinal extent of driving means 50 to be increased along with a corresponding increase in the length of protrusions 2 and cavities 22, and thereby column 20, for achieving the desired driving force on disks 40, without changing or affecting the quiescent spacing between surfaces 44 of disks 40. Thus, disks 40 may be spaced at the minimum acceptable distance, in order to obtain a wide bandwidth, while driving means 50 may be longitudinally lengthened for increasing overall power output from transducer 10 without affecting the minimum acceptable distance.

For the embodiment of FIG. 1, the amount of total displacement and resulting magnitude of flexure or excursions across the radiating surfaces that can be imparted to the member containing the radiating surfaces is directly proportional both to the total change in length of the driving means when it is activated, such as by being influenced by an electric or magnetic field, and to the magnitude of the force resulting from such change in length that is coupled transversely the radiating surfaces. Generally, the greater the amount of such total displacement and resulting magnitude of flexure or excursions of the disk, the more transmitting medium coupled to the radiating surface will be moved or perturbed, and the larger will be the amplitude of the wave or pulse of energy that is coupled from the radiating surface to the transmitting medium.

In accordance with the present invention, in order to maintain the total displacement of driving means 50 constant when activated, while reducing spacing 29 between disks 40, the overall length of chamber 20 may remain the same with corresponding lengths of protrusions 25 along with cavities 22 thereof increased, without affecting spacing 29. Further, while maintaining a predetermined spacing 29, the longitudinal length of driving means 50 may be increased, along with a corresponding increase in the height of columns 20 and length of protrusions 25 for increasing the total displacement to which disks 40 may be subjected.

Generally, it is to be expected that the overall length of each of driving means 50 and corresponding length of column 20 would be the same and centered about space 45, so that each of protrusions 25 from each of disks 40 terminate at the same distance from surface 42 of its corresponding disk 40. However, non-uniform spacing and extension of components may be used if desired with an extreme represented by a case where only one of two protrusions 25 of a column 20 extends outwardly from its corresponding member 40.

During operation of transducer 10, driving means 50 would typically all be energized so that their outer physical dimensions, say in a longitudinal sense, would all change in the same direction, such as increase, for a first energization mode and would all change in the same but opposite direction, such as decrease, for a second energization mode. Operation in the first and second mode may be performed in a periodic or other desired regular or irregular pattern for generating energy waves corresponding to the pattern from surfaces 42 when transducer 10 is submerged in a transmitting medium.

Of course transducer 10 need not be always operated with disks 40 disposed so that surfaces 44 thereof are spaced at the minimum acceptable distance. Using the teachings of the present invention and for a predetermined length of driving means 50, the spacing between disks 40 may be chosen to lie from the minimum acceptable distance to a distance wherein the length of protrusion 25 from surface 42 is effectively zero (whereby protrusion 25 would not be needed and mounting means such as shown in U.S. patent application Ser. No. 07,633,142 could be used for connecting driving means 50 to disks 40, or a transducer in accordance with such earlier U.S. patent application may be used). The selection range of operational spacing of surfaces 44 and thereby surfaces 42 of disks 40 and the selection of a corresponding length for protrusion 25, in accordance with the present invention, would provide for a corresponding selectable bandwidth and steepness of resonance for transducer 10.

While only certain preferred features of the invention have been shown by way of illustration, many modifications and changes will occur to those skilled in the art. It is to be understood that the appended claims are intended to cover all such modifications and changes as fall within the true spirit and scope of the invention.

What is claimed is:

1. A transducer comprising:

a first and a second spaced apart member for defining an inner spacing between the first and second member, each member having a corresponding spaced apart radiating surface, the radiating surface for generating a wave of energy in a transmitting medium in response to a driving force communicated to the first and second member;

a plurality of containment means coupled to the first and second member and extending outwardly beyond at least one of the radiating surfaces, the containment means for communicating the driving force to the first and second member;

a corresponding plurality of driving means respectively disposed within and coupled to the containment means, the driving means for generating the driving force in response to a change in a predetermined dimension of the driving means from influence by excitation energy; and sealing means connected to the first and second member, the sealing means for preventing transmitting fluid from entering the spacing between the first and second member.

2. The transducer as in claim 1, wherein the first and second member include a respective flat plate and the radiating surface includes a respective flat surface of the plate.

3. The transducer as in claim 2, wherein the containment means are coupled to each of the members for communicating the driving force to the first and second member and further wherein the containment means extend outwardly beyond each of the radiating surfaces.

4. The transducer as in claim 3, wherein the containment means include a protrusion extending outwardly from each radiating surface, each protrusion including a central cavity, a corresponding central cavity being mutually aligned for receiving the driving means.

5. The transducer as in claim 2, wherein the first and second plate are disposed with respect to each other such that the radiating surfaces are parallel to each other.

6. The transducer as in claim 5, wherein the containment means include a respective longitudinal axis and further wherein the longitudinal axis of the containment means is disposed perpendicular to the radiating surface of the first member.

7. The transducer as in claim 5, wherein the driving means include a respective longitudinal axis and further wherein the longitudinal axis of the driving means is disposed perpendicular to the radiating surface of the first member.

8. The transducer as in claim 5, wherein the longitudinal extent of the containment means is selectable so that the distance between the first and second member may be predeterminedly selected for operation at a predetermined bandwidth, the bandwidth inversely proportional to the value of the distance.

9. The transducer as in claim 5, wherein the distance between the first and second member is at a minimum acceptable distance so that the first and second members do not contact each other when the driving force is communicated to the first and second member, whereby a maximum bandwidth may be obtained.

10. The transducer as in claim 5, wherein the first and second plate include a respective cylindrical margin to define a disk, and further wherein the containment means are circumferentially spaced apart with respect to each other.

11. A transducer assembly having a selectable steepness of resonance and a corresponding selectable bandwidth, comprising:

radiating means having a first and a second spaced apart surface, the first and second surface disposed at a first predetermined spacing with respect to each other and each surface for generating a wave of energy in response to a driving force;

driving means coupled to the radiating means and extending beyond the first surface, the driving means having a quiescent longitudinal dimension, the driving means for changing the size of the longitudinal dimension in response to excitation energy, wherein a change in longitudinal dimension imparts a component of the driving force transverse the first and second surface, and further wherein the bandwidth is inversely proportional to the value of the predetermined spacing; and sealing means connected to the radiating means, the sealing means for preventing transmitting fluid from entering the spacing between the first and second surface, wherein the radiating means include a first and second flat disk, the first surface being disposed on the first disk and the second surface being disposed on the second disk and the driving means include a plurality of circumferentially spaced apart containment means connected to the first and second disk, the containment means for coupling the component of the driving force to the first and second disk.

12. A method for selecting the bandwidth of a transducer, comprising:

providing a spaced apart first and a second member to form a space therebetween, the first and second member having a respective radiating surface for generating a wave of energy in a transmitting medium in response to a driving force;

disposing plurality of containment means to extend outwardly beyond at least one of the radiating surfaces for communicating the driving force to the first and second member;

coupling one of a corresponding plurality of driving means to a respective one of the containment means for generating the driving force in response to a change in a predetermined dimension of the driving means; and sealing the space between the first and second member against invasion by transmitting medium, wherein the bandwidth of the transducer is inversely proportional to the distance between the respective radiating surfaces.

13. The method as in claim 12, wherein the step of disposing further includes disposing the plurality of containment means to extend outwardly beyond both of the radiating surfaces.

14. The method as in claim 12, wherein the first and second member include a respective flat plate and further wherein:

the step of providing includes disposing first and second plate so that the respective radiating surfaces are parallel each other; and the step of disposing includes disposing the plurality of containment means so that a longitudinal axis thereof is perpendicular one of the radiating surfaces.

15. The method as in claim 12, wherein the first and second member include a respective flat plate and further wherein:

the step of providing includes disposing first and second plate so that the respective radiating surfaces are parallel each other; and the step of coupling includes coupling so that a longitudinal axis of the one of a corresponding plurality of driving means is disposed perpendicular one of the radiating surfaces.

* * * * *